US008205874B2

(12) United States Patent
Krüger

(10) Patent No.: US 8,205,874 B2
(45) Date of Patent: Jun. 26, 2012

(54) DEVICE AND METHOD FOR ISOLATING SECURITIES OF A STACK OF SECURITIES

(75) Inventor: Uwe Krüger, Berlin (DE)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 13/125,529

(22) PCT Filed: Oct. 20, 2009

(86) PCT No.: PCT/EP2009/063732

§ 371 (c)(1),
(2), (4) Date: May 13, 2011

(87) PCT Pub. No.: WO2010/046359

PCT Pub. Date: Apr. 29, 2010

(65) Prior Publication Data

US 2011/0233850 A1 Sep. 29, 2011

(30) Foreign Application Priority Data

Oct. 22, 2008 (DE) ..... 10 2008 052 694

(51) Int. Cl.
*B65H 1/00* (2006.01)

(52) U.S. Cl. ..... 271/145; 902/9; 902/12

(58) Field of Classification Search ..... 271/145; 902/9, 12; 109/49.5, 64, 66
See application file for complete search history.

(56) References Cited

U.S. PATENT DOCUMENTS

| | | | | |
|---|---|---|---|---|
| 4,733,765 | A * | 3/1988 | Watanabe | 194/206 |
| 5,199,697 | A * | 4/1993 | Yamada et al. | 271/122 |
| 5,927,936 | A * | 7/1999 | Arikawa et al. | 414/788 |
| 7,086,585 | B2 * | 8/2006 | Lee | 235/379 |
| 7,540,490 | B2 * | 6/2009 | Suzuki et al. | 271/126 |
| 7,708,192 | B2 * | 5/2010 | Yokoi et al. | 235/379 |

FOREIGN PATENT DOCUMENTS

| | | | |
|---|---|---|---|
| DE | 197 36 453 | A1 | 2/1999 |
| DE | 197 48 864 | A1 | 5/1999 |
| EP | 0148310 | A2 | 7/1985 |
| EP | 0 471 300 | A2 | 2/1992 |
| EP | 1 489 027 | A1 | 12/2004 |

OTHER PUBLICATIONS

Notification of Transmittal of Copies of Translation of the International Preliminary Report on Patentability for PCT/EP2009/063732 (May 5, 2011).

* cited by examiner

*Primary Examiner* — David H Bollinger
(74) *Attorney, Agent, or Firm* — Harness, Dickey & Pierce, P.L.C.

(57) ABSTRACT

The invention relates to a device and a method for separating notes of value of a value note stack. The device comprises at least one input tray having an opening for the insertion of the value note stack and at least one closing element for closing and opening the opening of the input tray. Further, the device has at least one pressure element for pressing the notes of value inserted into the input tray against a pull-off element. The closing element and the pressure element are connected to each other.

14 Claims, 7 Drawing Sheets

DEVICE AND METHOD FOR ISOLATING SECURITIES OF A STACK OF SECURITIES

CROSS-REFERENCE TO RELATED APPLICATIONS

This application is a National Stage of International Application No. PCT/EP2009/063732, filed Oct. 20, 2009. This application claims the benefit and priority of German application 10 2008 052 694.0 filed Oct. 22, 2008. The entire disclosures of the above applications are incorporated herein by reference.

BACKGROUND

This section provides background information related to the present disclosure which is not necessarily prior art.

1. Technical Field

The invention relates to a device for separating notes of value of a value note stack with at least one input tray having an opening for the insertion of the value note stack. The device comprises a pressure element which presses the notes of value inserted into the input tray against a pull-off element. Further, the device comprises a closing element for closing and opening the opening of the input tray.

2. Discussion

Further, the invention relates to a method for separating notes of value of a value note stack, in which the value note stack is inserted into an input tray through an opening of the input tray and the inserted value note stack is pressed against a pull-off element with the aid of a pressure element.

The device and the method are preferably used in cash deposit machines and cash recycling machines. It is important that the input tray is closed by the closing element after insertion of the value note stack so that an access to the value note stack by the person who inserted the value note stack into the input tray or by another person, as well as vandalism and other manipulation attempts are prevented or at least made more difficult. For this, the closing element must close the opening prior or during the separation of the notes of value of the value note stack and must keep it closed during the separation of the notes of value of the value note stack. The notes of value of the value note stack have to be pressed against the pull-off element with a predetermined force so that reliably only the note of value of the value note stack lying against the pull-off element is pulled off, and thus a correct separation of the notes of value of the value note stack takes place.

One possibility of achieving both a closing of the input tray by the closing element and the pressing of the value note stack against the pull-off element by the pressure element after insertion of the value note stack into the input tray is to drive both the closing element and the pressure element by one drive unit each. As drive units, preferably electric motors are used. When using two drive units it is disadvantageous that the two drive units have a large space requirement, as a result whereof a compact design of the device for separating notes of value is made more difficult. Further, the use of two drive units is cost-intensive.

SUMMARY OF THE INVENTION

It is an aspect of the invention to specify a device and a method by which an input tray is easily closed and by which a value note stack inserted into the input tray is easily pressed against at least one pull-off element.

The invention preferably includes a closing element for closing and opening the opening of an input tray for the insertion of notes of value of a value note stack and a pressure element for pressing the notes of value inserted into the input tray against a pull-off element can be driven jointly as a result of their interconnection.

It is advantageous when the closing element and the pressure element are connected to each other via at least one connecting element. In particular, it is advantageous when the closing element and the pressure element are connected to each other via at least one connecting element such that the relative position of the closing element and the pressure element to each other is not unchangeable, as in the case of a rigid connection of the closing element and the pressure element. Rather, the relative position of the connecting element and the pressure element to each other is changeable. Hereby it is achieved that the closing element and the pressure element can be driven together and more complex paths of motion of the pressure element and/or of the connecting element are possible.

Further, it is advantageous when the mechanical connection of the closing element and the pressure element is established via at least one hinge connection. It is particularly advantageous to provide a hinge pin as a connecting element. By way of such a hinge connection it is achieved that the closing element and the pressure element are rotatably or pivotably connected to each other.

Further, it is advantageous to provide a drive unit for opening and closing the closing element. It is particularly advantageous when the drive unit comprises a motor which is engaged with the closing element via a slotted link and a sliding block. By connecting the closing element and the pressure element to each other it is achieved that the drive unit not only drives the closing element but also the pressure element. Hereby, only one drive unit for driving the closing element and the pressure element is required without these being rigidly connected to each other. Hereby, a compact design of the device is achieved. Further, the use of only one drive unit minimizes the costs.

In addition, it is advantageous when the pull-off element comprises at least one pull-off roll. Hereby it is achieved that the note of value of the value note stack lying against the pull-off element can be pulled off particularly easily.

Further, it is advantageous when the input tray comprises at least one guiding plate opposite to the pressure element, a basic frame and a limiting element. In this way, on the one hand, an additional guidance of the notes of value inserted into the input tray is achieved and, on the other hand, undesired access to the notes of value inserted into the input tray is prevented.

Further, it is advantageous when the pull-off element projects through the guiding plate. Hereby, a contact between the pull-off element and the note of value of the value note stack that faces the pull-off element is guaranteed, the value note stack being pressed against the pull-off element.

In addition, it is advantageous when the device comprises at least one leg spring, the first leg of which presses against the side of the pressure element facing away from the pull-off element and the second leg of which presses against the side of the closing element facing the input tray. With the aid of the leg spring a force can be transmitted between the closing element and the pressure element.

Further, it is advantageous when the device comprises a control unit. The control unit controls the drive unit for driving the closing element in an input mode such that the opening of the input tray is opened and the pressure element is arranged at a distance to the pull-off unit for unblocking an input area. Further, the control unit controls the drive unit for driving the closing element in a separating mode such that the opening of the input tray is at least partially closed and the pressure element presses the value note stack inserted into the input tray against the pull-off element. Advantageously, the opening of the input tray is closed in the separating mode at least so far that access from outside is no longer possible. Further, the control unit controls the drive unit for driving the closing element in a standby mode such that the opening of the input tray is completely closed.

It is advantageous when the pressure element has a sliding element at the end opposite to the closing element and when the basic frame has a slide rail, the sliding element of the pressure element sliding at least temporarily along the slide rail of the basic frame when the pressure element is displaced. By the sliding of the sliding element of the pressure element along the slide rail of the basic frame, an additional guidance of the pressure element is achieved. In particular, it is achieved that the pressure element is arranged always almost parallel to the guiding plate.

Further, the invention relates to a method for separating notes of value of a value note stack, in which the value note stack is inserted into an input tray through an opening of the input tray. Further, the inserted value note stack is pressed against a pull-off element with the aid of a pressure element connected to the closing element for closing and opening the opening of the input tray. It is advantageous when the closing element and the pressure element are connected to each other such that, on the one hand, during closing of the closing element, the pressure element is automatically moved such that the value note stack is pressed against the pull-off unit with the aid of the pressure element, and that, on the other hand, during opening of the closing element, the pressure element is automatically moved away from the pull-off element. Hereby it is achieved that only the closing element has to be driven and the pressure element automatically performs the desired movement.

BRIEF DESCRIPTION OF THE DRAWINGS

Further features and advantages of the invention result from the following description which in connection with the enclosed Figures explains the invention in more detail with reference to embodiments.

Figure 1:
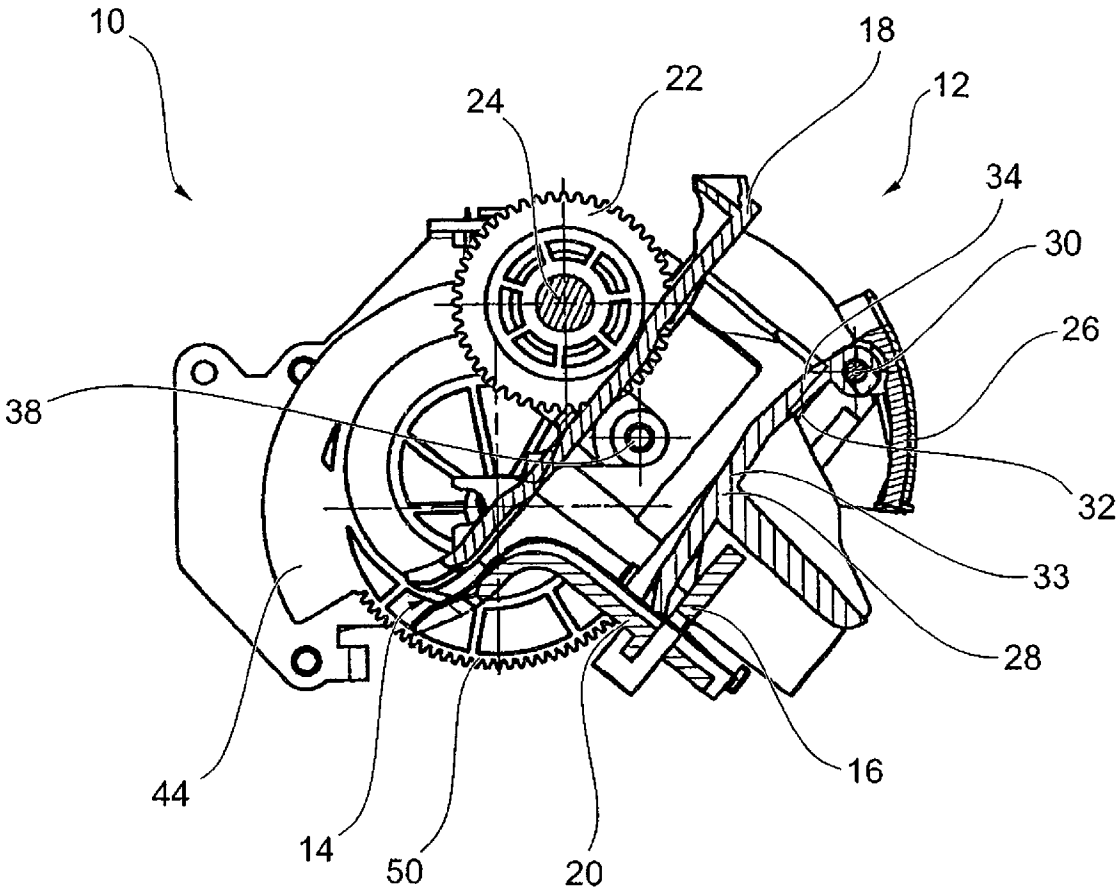
FIG. 1 shows a schematic illustration of a first cross-section of a device for separating notes of value in an input mode.

The drawings described herein are for illustrative purposes only of selected embodiments and not all possible implementations, and are not intended to limit the scope of the present disclosure.

DETAILED DESCRIPTION OF THE PREFERRED EMBODIMENTS

Example embodiments will now be described more fully with reference to the accompanying drawings.

Corresponding reference numerals indicate corresponding parts throughout the several views of the drawings.

In FIG. 1, a schematic illustration of a first cross-section of a device 10 for separating notes of value of a value note stack is shown in an input mode. The device 10 is also referred to as input and separating module. The notes of value are in particular bank notes. Alternatively, in particular receipts can also be supplied to the device 10.

The device 10 is used in an automated teller machine, preferably in a cash deposit machine or a cash recycling machine. The value note stack is inserted into an input area of an input tray 12 of the device 10 by a customer. The device 10 serves to pull the notes of value of the inserted value note stack individually out of the input tray 12 and to feed them through a gap 14 to a non-illustrated transport path of the automated teller machine.

The input tray 12 comprises a basic frame 16, a guiding plate 18 arranged parallel to the basic frame 16 and a limiting element 20. The almost L-shaped limiting element 20 is arranged such that the longer part of the limiting element 20 is arranged orthogonally to the basic frame 16 and to the guiding plate 18, and that the shorter part of the limiting element 20 is arranged almost parallel to the guiding plate 18. The gap 14 through which the pulled-off notes of value are transported away is limited by the shorter part of the limiting element 20 and by the guiding plate 18.

Further, the device 10 comprises a pull-off roll 22. The pull-off roll 22 is connected to a shaft 24 in a rotationally fixed manner. The shaft 24 can be driven by a non-illustrated drive unit. The pull-off roll 22 is advantageously arranged such that it projects into the input tray 12 through a cut-out in the guiding plate 18 and thus has access to a value note stack inserted into the input tray. The generated surface of the pull-off roll 22 has a toothing to increase the friction between the pull-off roll 22 and the note of value of the value note stack inserted into the input tray 12 and facing the pull-off roll 22.

Alternatively, instead of the pull-off roll 22 also other rotational elements, in particular rollers, can be used. Further, also several pull-off rolls 22, such as two pull-off rolls 22, can be arranged on the shaft 24. Here, it is advantageous when the pull-off rolls have a distance to each other so that they are not directly adjacent to each other. Further, in the alternative, also one or more pull-off rolls without toothing and with a smooth generated surface can be used.

Further, the device 10 comprises a closing element 26 for opening and closing the opening of the input tray 12. The closing element 26 is also referred to as shutter 26. In the present embodiment, the shutter 26 has the form of a cylinder segment. The opening and the closing of the shutter 26 takes place with the aid of a drive unit 52 not visible in FIG. 1. The drive unit 52 is preferably an electric motor. The mechanical connection between the shutter 26 and the drive unit will still be explained in more detail in the following in connection with FIG. 4.

The device 10 further comprises a pressure element 28 which is arranged within the input tray 12 of the device 10. The pressure element 28 is also referred to as pressure plate. The pressure element 28 serves to press the value note stack inserted into the input area of the input tray 12 against the pull-off roll 22 so that the note of value of the value note stack that faces the pull-off roll 22 can be pulled off from the value note stack with the aid of the pull-off roll 22 and can be transported away through the gap 14. Together with the guiding plate 18 and the limiting element 20, the pressure element 28 limits the input area of the input tray 12.

The pressure element 28 and the shutter 26 are rotatably connected to each other via at least one hinge connection. For this, a first end of the pressure plate 28 and a first end of the shutter 26 are formed such that they are rotatably connectable with the aid of a hinge pin 30.

Further, the device 10 comprises a leg spring 32. The leg spring 32 is arranged such that a first leg of the leg spring 32 presses against the side of the pressure element 28 facing away from the guiding plate 18 and that a second leg of the leg spring 32 presses against the side of the shutter 26 facing the pressure element 28. Alternatively, the device 10 can also comprise several leg springs 32 arranged parallel to one another or other spring arrangements causing a corresponding spring force.

At a second end opposite to the first end, the pressure element 28 comprises a sliding element not visible in FIG. 1. Further, the limiting element 20 comprises a slide rail which is likewise not visible.

In FIG. 1, the device 10 is illustrated in the input mode. In the input mode, the shutter 26 is opened as far as possible, and the pressure element 28 is arranged in the input tray 12 at the side of the basic frame 16. Hereby, the input area of the input tray 12 has its maximum size, as a result whereof the value note stack can comfortably be inserted into the input tray by a bank customer or another person. In the input mode, a first partial area 33 of the pressure element 28 is arranged parallel to the guiding plate 18. A second partial area 34 of the pressure element 28 is slightly bent relative to the first partial area 33 of the pressure element 28 so that, as a result thereof, the opening of the input tray 12 is enlarged. Hereby, the insertion of the value note stack into the input area of the input tray 12 is further simplified.

Figure 2:
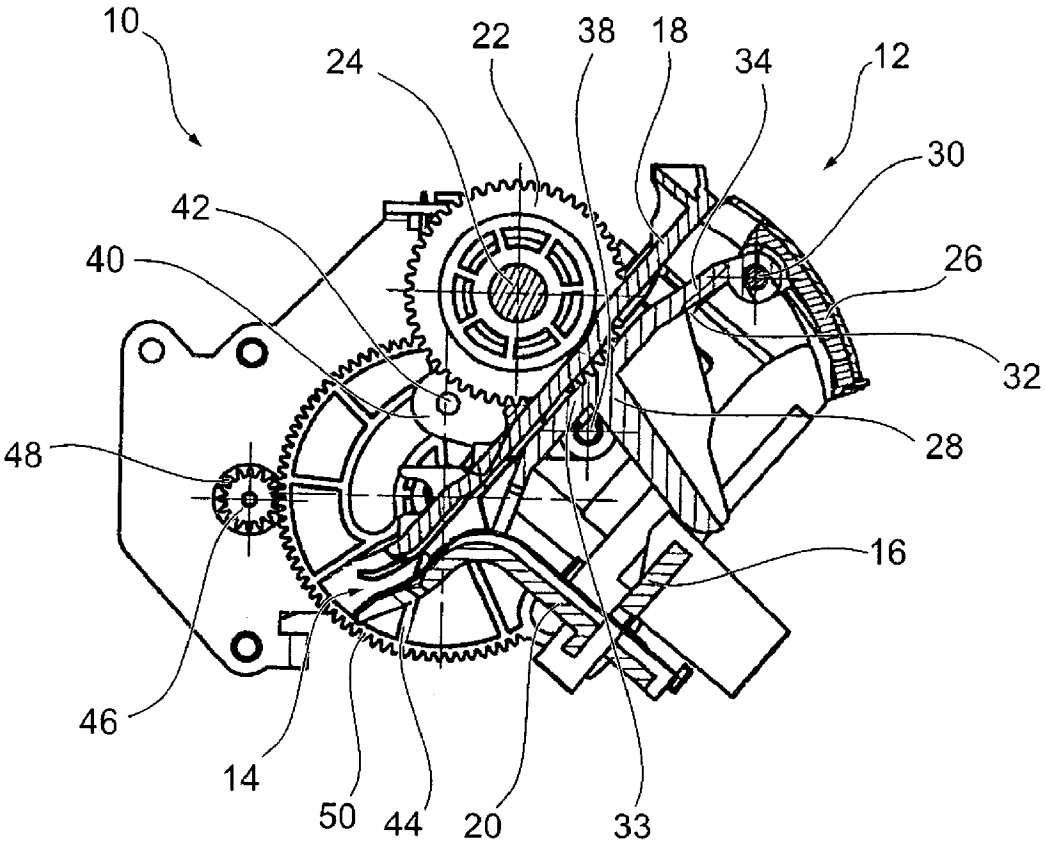
FIG. 2 shows a schematic illustration of a first cross-section of the device according to FIG. 1 in a separating mode.

In FIG. 2, a schematic illustration of a first cross-section of the device 10 according to FIG. 1 is illustrated in a separating mode. Elements having the same structure or the same function are identified by the same reference signs.

In the separating mode, the value note stack inserted into the input area of the input tray 12 is pressed with a predetermined force against the pull-off roll 22 with the aid of the pressure element 28 so that the note of value of the value note stack which faces the pull-off roll 22 is in contact with the pull-off roll 22 and can be removed from the value note stack with the aid of the pull-off roll 22 and can be transported away through the gap 14. In the separating mode, too, the first partial area 33 of the pressure element 28 is arranged parallel to the guiding plate 18. The shutter 26 is at least partially closed in the separating mode so that access from outside to the value note stack inserted into the input area of the input tray 12 is not possible or made more difficult. As a result thereof, manipulations are prevented or made more difficult. Advantageously, the opening of the input tray 12 is completely closed by the shutter 26 in the separating mode.

The closing of the shutter 26 takes place with the aid of the drive unit 52. The shutter 26 performs an anti-clockwise rotation during closing.

As a result of the connection between the shutter 26 and the pressure element 28 by means of the hinge connection and the leg spring 32, the pressure element 28 is automatically moved in the direction of the guiding plate 18 during closing of the shutter 26. As a result thereof, the inserted value note stack is automatically pressed against the pull-off roll 22 with the aid of the pressure element 28. For displacing the pressure element 28 in the direction of the guiding plate 18 thus no further drive unit is required. When the shutter 26 is closed and is thus moved in the direction of the guiding plate 18, then also the first end of the pressure element 28 connected to the shutter 26 via the hinge connection is moved in the direction of the guiding plate 18. Due to the spring force of the leg spring 32 here not only the first end of the pressure element 28 is moved in the direction of the guiding plate 18 but the entire pressure element 28 is displaced in the direction of the guiding plate 18. When the pressure element 28 is displaced, the sliding element of the pressure element 28 at least temporarily slides along the slide rail of the basic frame 16. By way of the sliding element of the pressure element 28 the torque generated by the leg spring 32 bears against the slide rail of the basic frame 16 such that the pressure plate 28 is held always almost parallel to the guiding plate 18. When the value note stack is pressed against the pull-off roll 22, then the sliding element of the pressure element 28 is lifted from the slide rail of the basic frame 16 and the pressure plate 28 presses the value note stack against the pull-off roll 22 with the aid of the spring force of the leg spring 32.

Figure 3:
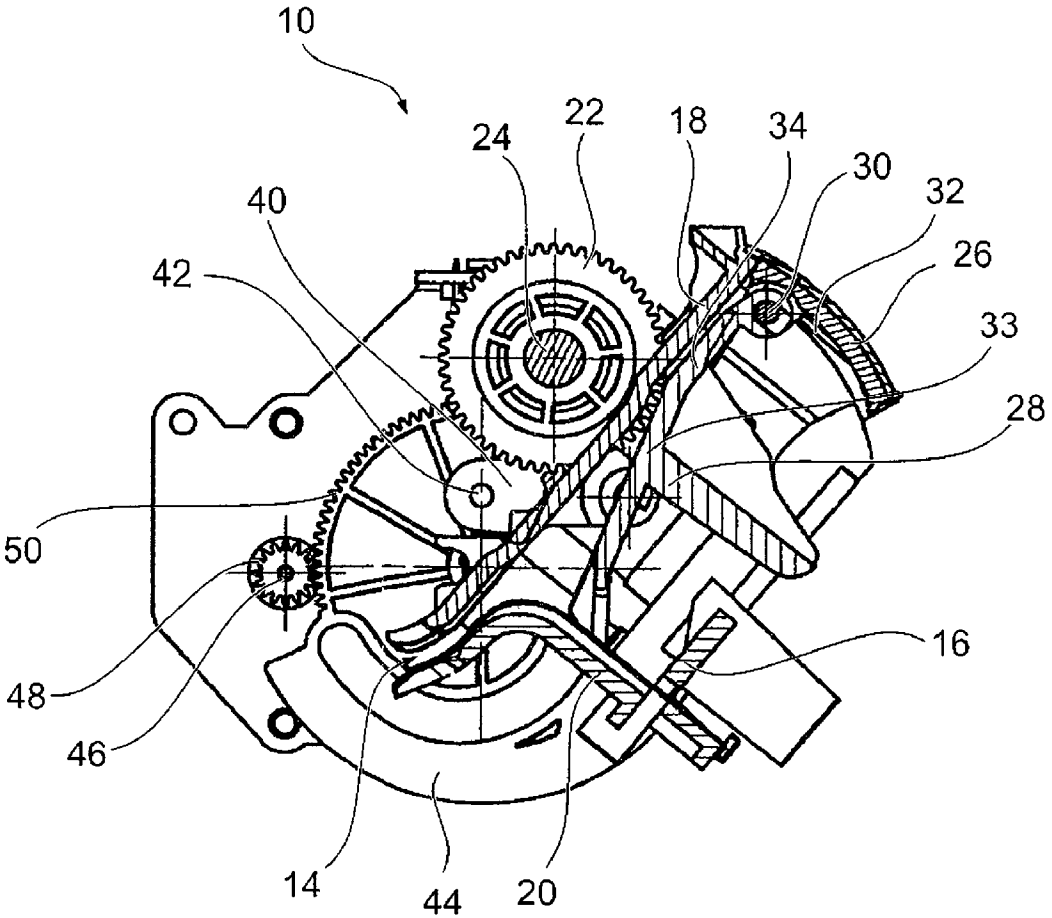
FIG. 3 shows a schematic illustration of a first cross-section of the device according to FIGS. 1 and 2 in a standby mode.

In FIG. 3, a schematic illustration of a first cross-section of the device 10 according to FIGS. 1 and 2 is illustrated in a standby mode. In the standby mode, notes of value are no longer present in the input tray 12. The shutter 26 is completely closed in the standby mode so that the input tray cannot be accessed from outside. Further, by way of the closed shutter 26, the ingress of dirt, such as dust, into the input tray 12 of the device 10 is prevented. When the shutter 26 is completely closed, the pressure element 28 is further pivoted into the free space of the input tray 12. In the standby mode, the second partial area 34 of the pressure element 28 bears against the guiding plate 18. The first partial area 33 of the pressure element 28 is no longer arranged parallel to the guiding plate 18 in the standby mode.

Figure 4:
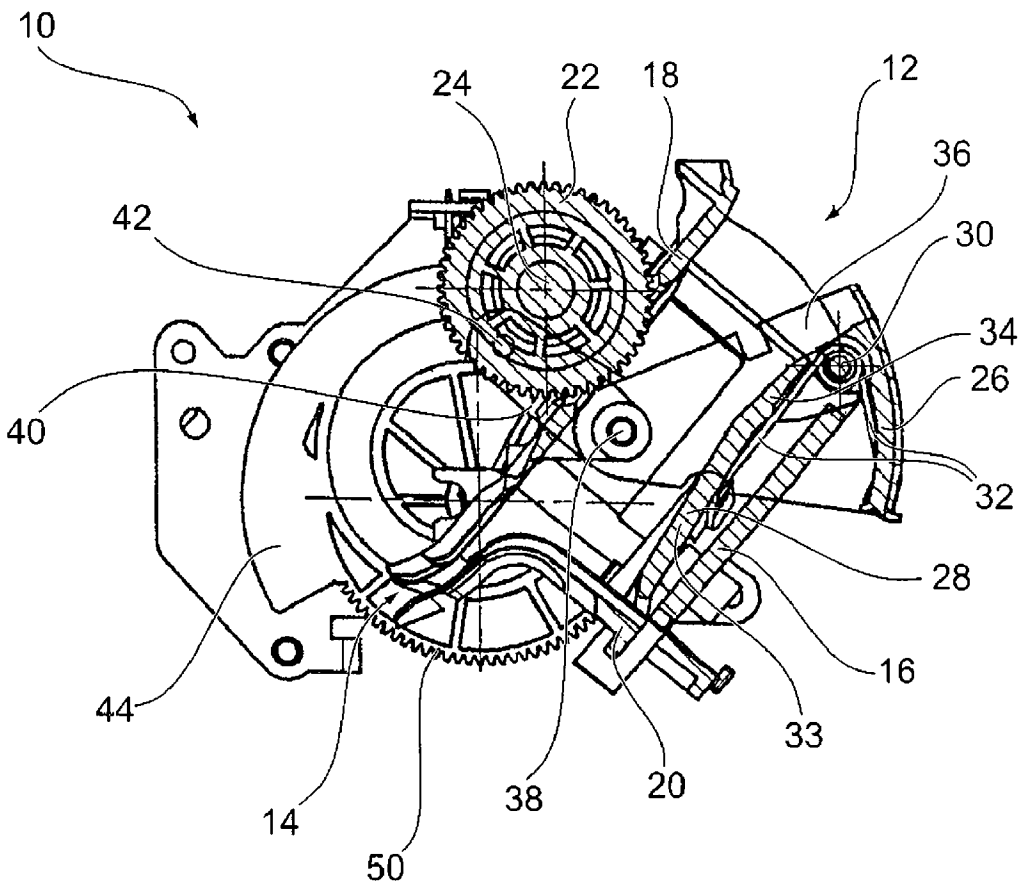
FIG. 4 shows a schematic illustration of a second cross-section of the device according to FIGS. 1 to 3 in the input mode.

In FIG. 4, a schematic illustration of a second cross-section of the device 10 according to FIGS. 1 to 3 is illustrated in the input mode. The elements which serve to mechanically connect the shutter 26 to the drive unit 52 are illustrated in solid lines in FIG. 4, although the elements lie completely or partially behind other elements and are thus actually hidden.

One end of the shutter 26 is rigidly connected to an end of a mechanical element 36. The second end of the mechanical element 36 opposite to the first end is rotatably connected to a first end of a drive lever 40 via a connecting element 38. The end of the drive lever 40 opposite to the first end of the drive lever 40 is connected to a sliding block 42. The sliding block 42 is guided in a slotted link 44. When the slotted link 44 is rotated with the aid of the drive unit 52, then the sliding block 42 performs a movement predetermined by the slotted link. Due to the connection between the sliding block 42 and the shutter 26 via the mechanical element 36, the connecting element 38 and the drive lever 40, the shutter 26 likewise performs a predetermined movement for closing or, respectively, opening the opening of the input tray 12.

Figure 5:
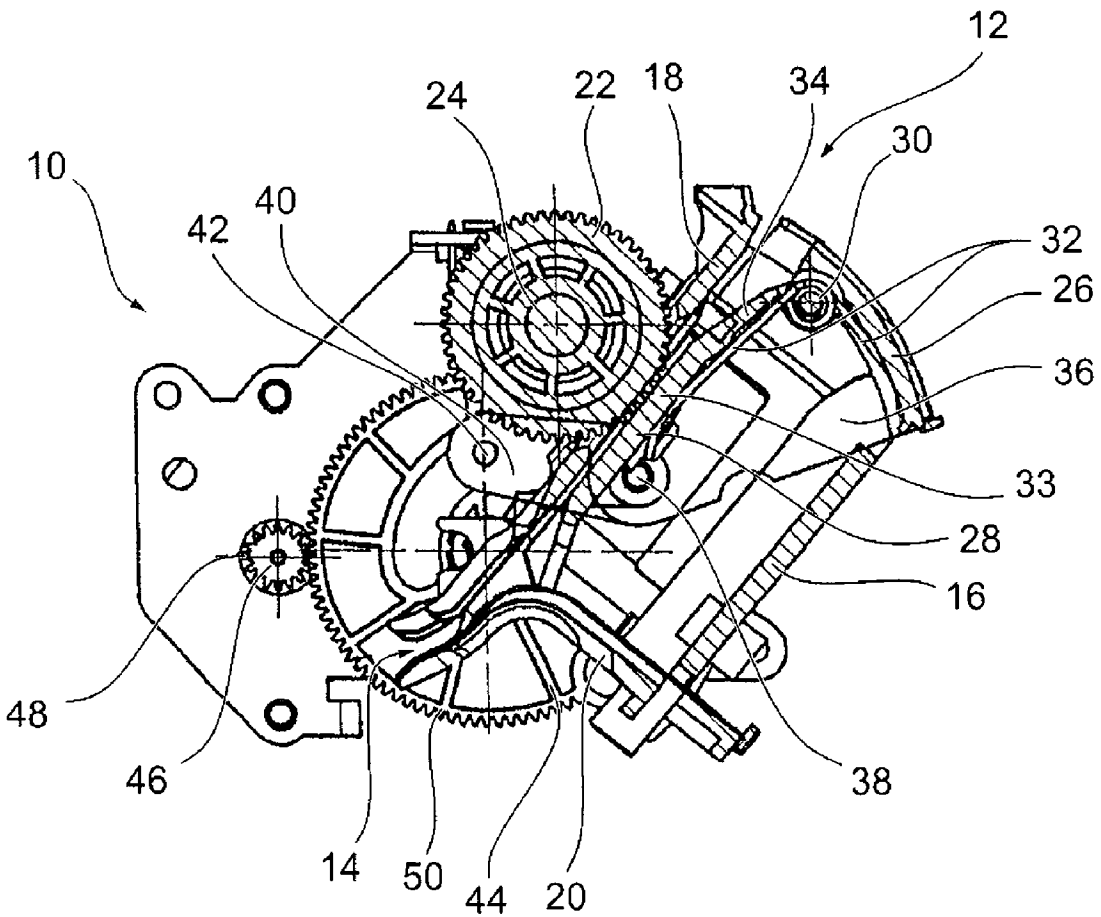
FIG. 5 shows a schematic illustration of a second cross-section of the device according to FIGS. 1 to 4 in a separating mode.

In FIG. 5, a schematic illustration of a second cross-section of the device 10 according to FIGS. 1 to 4 is illustrated in the separating mode. The elements that serve to mechanically connect the shutter 26 and the drive unit 52 are illustrated in solid lines in FIG. 5, just as in FIG. 4, although they are completely or partially covered by other elements. The device 10 comprises a gearwheel 46. The toothing 48 of the gearwheel 46 engages with a toothing 50 of the slotted link 44 that is complementary to the toothing 48 of the gearwheel 46. The gearwheel 46 is engaged with the drive unit 52. When the gearwheel 46 is rotated with the aid of the drive unit 52, then the slotted link 44 is likewise rotated.

Figure 6:
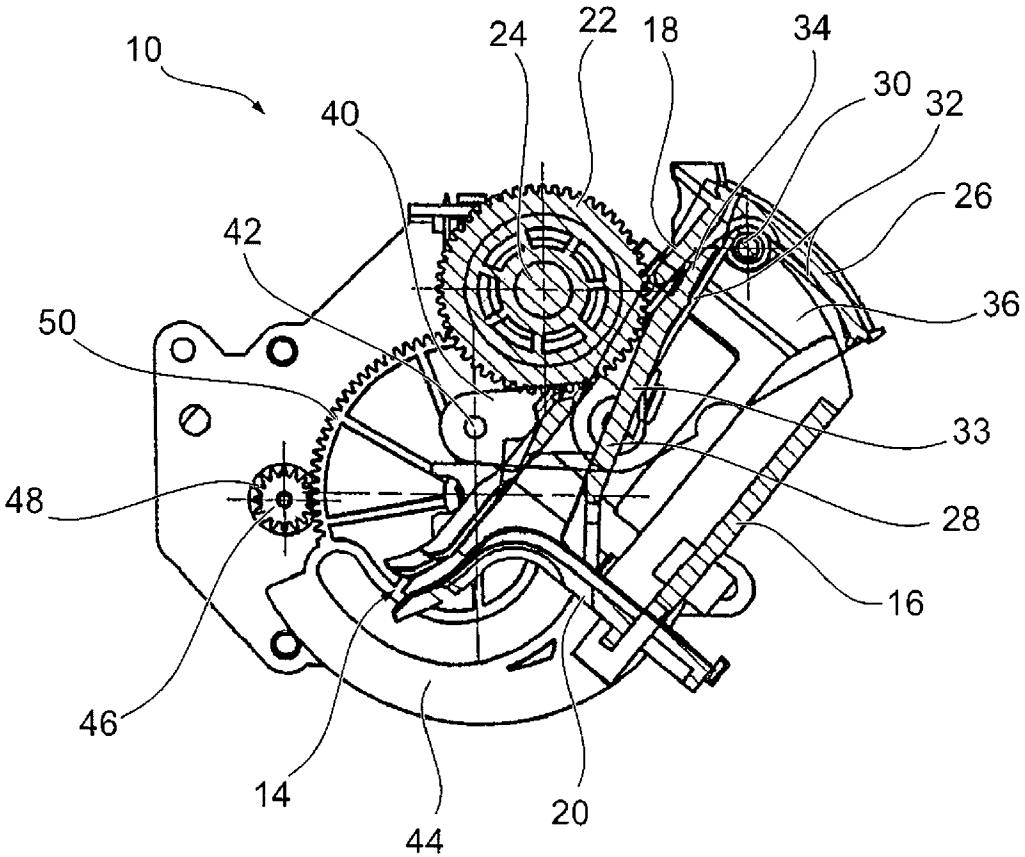
FIG. 6 shows a schematic illustration of a second cross-section of the device according to FIGS. 1 to 5 in the standby mode.

In FIG. 6, a schematic illustration of a second cross-section of the device 10 according to FIGS. 1 to 5 is illustrated in the standby mode. The elements which serve to mechanically connect the drive unit 52 and the shutter 26 are illustrated in solid lines in FIG. 6, just as in FIGS. 4 and 5.

Figure 7:
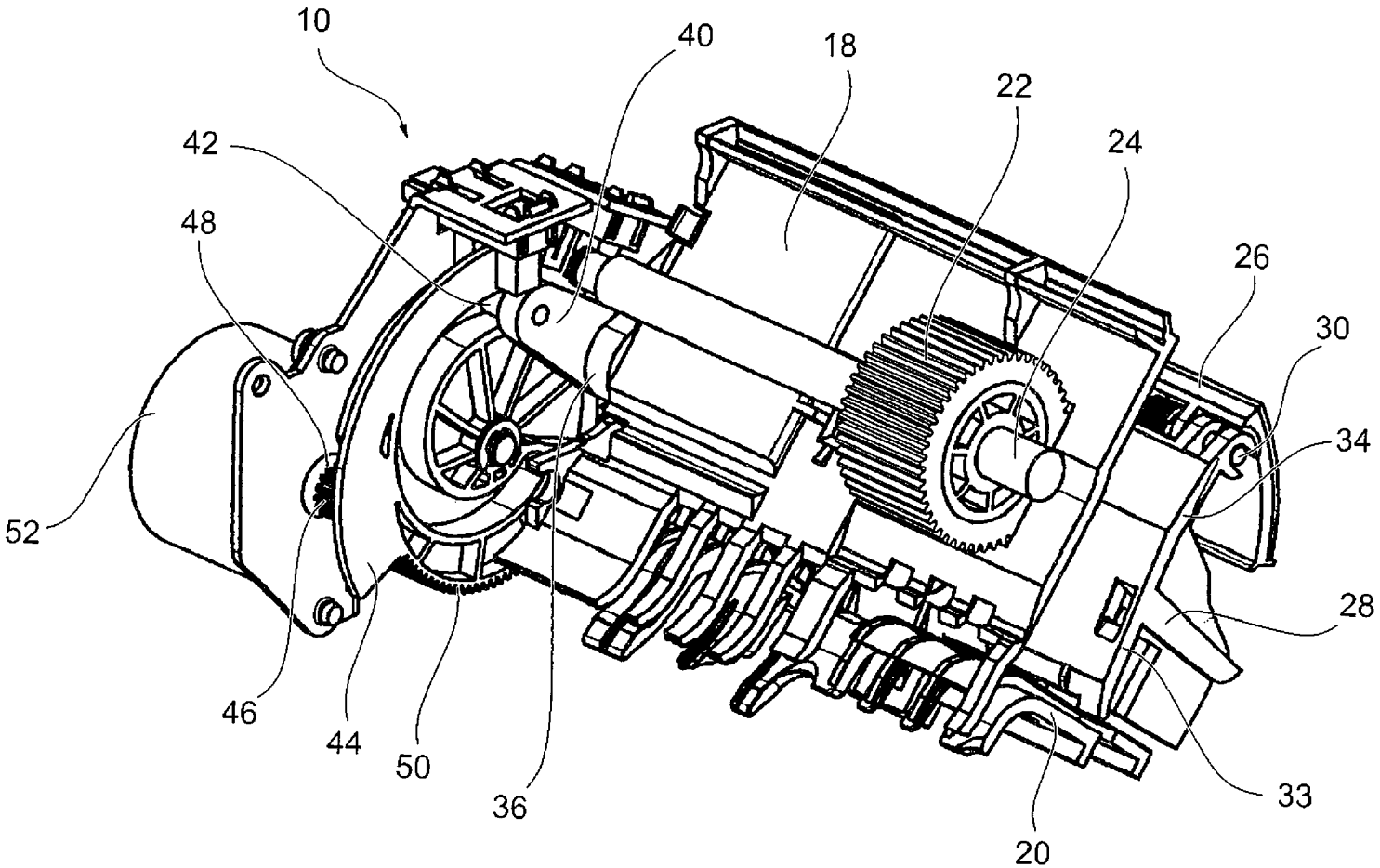
FIG. 7 shows a perspective schematic illustration of the device according to FIGS. 1 to 6.

In FIG. 7, a schematic perspective illustration of the device 10 according to FIGS. 1 to 6 is illustrated. The gearwheel 46 is connected to the drive unit 52 in a rotationally fixed manner.

During opening of the shutter 26, the pressure element 28 is automatically moved away from the guiding plate 18 in the direction of the basic frame 16 due to the connection between the shutter 26 and the pressure element 28 until the shutter 26 and the pressure element 28 have reached their position defined for the input mode.

In an alternative embodiment of the invention, the shutter 26 and the pressure element 28 can be connected to each other in a rotationally fixed manner and stationarily. Advantageously, the shutter 26 and the pressure element 28 are designed as one component part. Further, the device 10 can additionally comprise a control unit which serves to control the drive unit 52.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A device for separating notes of value of a value note stack, said device comprising:

at least one input tray having an opening for the insertion of the value note stack;

at least one closing element for closing and opening the opening of the input tray;

a drive unit configured to open and close the closing element; and at least one pressure element for pressing the notes of value inserted into the input tray against a pull-off element;

the closing element and the pressure element being connected to each other such that they can be driven jointly by the drive unit.

2. The device according to claim 1, wherein the closing element and the pressure element are connected to each other via at least one connecting element.

3. The device according to claim 2, wherein a hinge pin is provided as a connecting element.

4. The device according to claim 1, wherein mechanical connection of the closing element and the pressure element is established via at least one hinge connection.

5. The device according to claim 1, wherein the drive unit comprises a motor that is engaged with the closing element at least via a slotted link and a sliding block.

6. The device according to claim 1, wherein the pull-off element comprises at least one pull-off roll.

7. The device according to claim 1, wherein the input tray comprises at least one guiding plate opposite to the pressure element, a basic frame and a limiting element.

8. The device according to claim 7, wherein the pull-off element projects through the guiding plate.

9. The device according to claim 1, wherein the device comprises at least one leg spring, a first leg of which presses against a side of the pressure element facing away from the pull-off element and a second leg of which presses against a side of the closing element facing the input tray.

10. The device according to claim 1, wherein the device comprises a control unit;

wherein the control unit controls the drive unit for driving the closing element into an input mode such that the opening of the input tray is opened and the pressure element is arranged at a distance to the pull-off unit for unblocking an input area;

wherein the control unit controls the drive unit for driving the closing element into a separating mode such that the opening of the input tray is at least partially closed and the pressure element presses the value note stack inserted into the input tray against the pull-off element; and wherein the control unit controls the drive unit for driving the closing element into a standby mode such that the opening of the input tray is completely closed.

11. The device according to claim 7, wherein the pressure element has a sliding element at an end opposite to the closing element, and the basic frame has a slide rail, wherein the sliding element of the pressure element slides at least temporarily along the slide rail of the basic frame when the pressure element is displaced.

12. The device according to claim 11, wherein the pressure element is guided with the aid of the slide rail of the basic frame such that for pressing the value note stack against the pull-off element a pressure area of the pressure element is arranged parallel to the guiding plate.

13. A method for separating notes of value of a value note stack, comprising:

in which the value note stack is inserted into an input tray through an opening of the input tray;

in which the inserted value note stack is pressed against a pull-off element with the aid of a pressure element connected to a closing element for closing and opening the opening of the input tray; and moving the closing element between an open position and a closed position with a drive unit, connection of the closing element to the pressure element jointly moves the pressure element with the closing element when the closing element is driven by the drive unit.

14. The method according to claim 13, wherein closing the closing element moves the pressure element such that the value note stack is pressed against the pull-off element with the aid of the pressure element, and opening the closing element moves the pressure element away from the pull-off element.

* * * * *